US006079456A

United States Patent [19]

Drabarek et al.

[11] Patent Number: 6,079,456

[45] Date of Patent: Jun. 27, 2000

[54] STRAPPING TOOL WITH IMPROVED STRAP GUIDE AND METHOD THEREFOR

[75] Inventors: Peter Drabarek, Chicago; Janusz Figiel, Mount Prospect, both of Ill.

[73] Assignee: Illinois Tool Works Inc., Glenview, Ill.

[21] Appl. No.: 09/286,913

[22] Filed: Apr. 6, 1999

[51] Int. Cl.[7] ..... B21F 9/02

[52] U.S. Cl. ..... 140/93.2; 140/123.6

[58] Field of Search ..... 100/29, 30, 32; 140/93.2, 93.4, 93.6, 123.5, 123.6

[56] References Cited

U.S. PATENT DOCUMENTS

| | | | |
|---|---|---|---|
| 2,040,576 | 5/1936 | Timmerbeil | 140/93.2 |
| 2,182,004 | 12/1939 | Spencer | 140/123.6 |
| 2,210,510 | 8/1940 | Sutton | 140/93.2 |

*Primary Examiner*—Lowell A. Larson
*Attorney, Agent, or Firm*—Donald J. Breh; Mark W. Croll; John P. O'Brien

[57] ABSTRACT

A strap guide and method therefor in a tensioning tool having a base plate, a wall portion disposed at least partially along and extending above a strap support surface of the base plate, a strap guiding member having a pivot end portion pivotally coupled to the tool along the strap support surface generally opposite the wall portion, and a biasing member coupled to the strap guiding member to pivotally bias a guide end portion of the strap guiding member above at least a portion of the strap support surface. Strap disposed on the strap support surface of the base plate is guided between the wall portion the strap guiding member during tensioning, and is released therefrom upon withdrawal of the base plate from between a load and tensioned strap.

19 Claims, 3 Drawing Sheets

STRAPPING TOOL WITH IMPROVED STRAP GUIDE AND METHOD THEREFOR

BACKGROUND OF THE INVENTION

The invention relates generally to strapping tools, and more particularly to strap tensioning tools having improved strap guides and methods therefor.

It is known generally to apply tensioned steel or plastic strap about a load with a power or manually operated hand held strap tensioning tool. Some tools also include means for fastening overlapping strap portions after tensioning, while other tools require a separate fastening tool for this purpose. In plastic strap tensioning tools, for example, it is known to include a vibrating jaw that frictionally fuses, or welds, overlapping strap portions. And in steel strap tensioning tools it is known to include a die assembly for sealess joining of overlapping strap portions. Other steel strap tensioning tools merely tension strap while a separate sealing member is crimped about overlapping strap portions by a seal crimping tool.

Strap tensioning tools operate generally by gripping a strap end portion while an overlapping strap portion disposed about the load is tensioned with a feed wheel. During tensioning, the overlapping strap portions and particularly the tensioned strap portion must be maintained in alignment with the feed wheel. It is known generally to provide a strap guide, usually upstream of the feed wheel, to maintain the strap in alignment therewith during tensioning.

Some known strap guides have an actuator mechanism to release strap engaged thereby after tensioning and sealing, for example by moving a lever connected thereto, so that the tool, usually a foot portion thereof, may be separated from the tensioned strap. Tool operators, however, are not receptive to tools having actuatable strap guides since additional labor is required to disengage the strap from the guide. The actuator mechanism also complicates the tool and increases the cost thereof.

Other known strap guides are relatively simple and do not include an actuator mechanism to release tensioned strap from the strap guide. In prior art FIG. 5 of the present application, for example, an end view of a known tensioning tool strap guide 11 is defined generally by downwardly extending side wall portions 12 and 14 between which overlapping strap portions are disposed during tensioning. As the strap is tensioned, however, it is ultimately pulled downwardly from between the strap guiding wall portions 12 and 14, toward the base plate 16 of the tool, as illustrated in prior art FIG. 6 of the present application. This prior art strap guide has the disadvantage that the strap is withdrawn from between the strap guide before tensioning is complete, whereupon it may become misaligned with the feed wheel during tensioning.

The invention is drawn generally toward advancements in the art of strap tensioning tools, and more particularly toward strap tensioning tools having improved strap guides and methods therefor.

An object of the invention is to provide novel strap tensioning tools having improved strap guides and methods therefor that overcome problems in the art.

Another object of the invention is to provide novel strap tensioning tools having improved strap guides and methods therefor that guide strap until tensioning is complete.

A further object of the invention is to provide novel strap tensioning tools having strap guides and methods therefor that do not require user operated release mechanisms to release strap from the strap guide to withdrawal the tool from between a load and strap tensioned thereabout after tensioning.

A further object of the invention is to provide novel strap tensioning tools having strap guides with a strap guiding member that is pivotal to release strap upon withdrawal of the tool from between a load and strap tensioned thereabout.

A more particular object of the invention is to provide a novel strap guide in a tensioning tool and methods therefor comprising generally a base plate, a wall portion disposed at least partially along and extending above a strap support surface of the base plate, a strap guiding member having a pivot end portion pivotally coupled to the tool along the strap support surface generally opposite the wall portion, a biasing member coupled to the strap guiding member to pivotally bias a guide end portion of the strap guiding member above at least a portion of the strap support surface, whereby strap disposed on the strap support surface of the base plate is guided between the wall portion and the strap guiding member during tensioning and is removable therefrom upon withdrawal of the base plate from between the load and tensioned strap.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
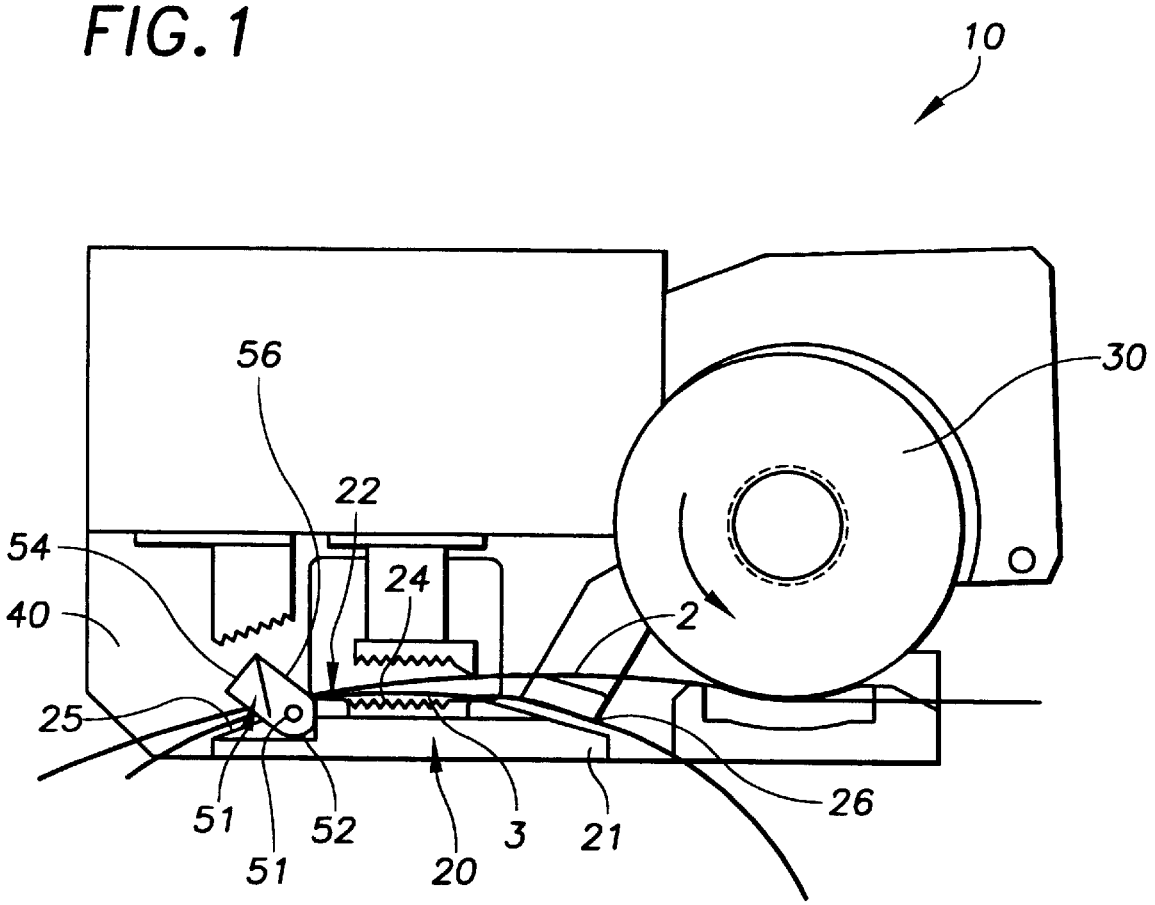
FIG. 1 side view of a strap tensioning tool having a strap guide according to an exemplary embodiment of the present invention.

FIG. 1 is a strap tensioning tool 10 comprising an improved strap guide according to an exemplary embodiment of the invention. The strap tensioning tool 10 comprises generally a foot or base plate 20 and feed wheel 30 frictionally engageable with a strap portion 2 disposed over the base plate for tensioning strap about a load.

The tool 10 in the exemplary embodiment of FIG. 1 is a plastic strap tensioning tool that further comprises, in addition to the base plate 20 and feed wheel 30, strap sealing means for frictionally welding or otherwise sealing overlapping strap portions after tensioning, as is known generally. The strap guide of the present invention, however, also may be used on steel strap tensioning tools, and tensioning tools without strap sealing means.

FIG. 1 illustrates the base plate 20 having a strap support surface 22 over which the strap 2 is drawn by the feed wheel 30 during tensioning. In the exemplary embodiment, the strap 2 is drawn over an underlying strap portion 3, wherein both strap portions 2 and 3 are supported by the strap support surface 22 of the base plate.

Figure 2:
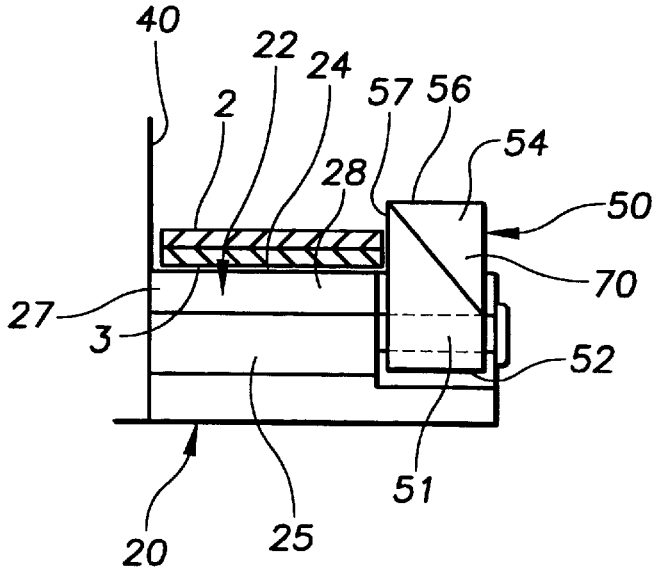
FIG. 2 is a partial end view of overlapping strap portions retained by an exemplary strap guide.

FIG. 1 illustrates the strap support surface 22 of the base plate 20 having generally an intermediate portion 24, and leading and trailing end portions 25 and 26 on opposing ends of the intermediate portion 24. FIG. 2 illustrates the strap support surface 22 having inner and outer portions 27 and 28 extending therealong from the leading end portion 25 to the trailing end portion 26. In the exemplary embodiment, the leading and trailing end portions 25 and 26 preferably slope generally downwardly away from the intermediate portion 24, as illustrated in FIG. 1, to reduce slack formed in strap tensioned about the load upon removal of the base plate 20 from between the overlapping tensioned strap portions 2 and 3 and the load.

In the exemplary embodiment, the feed wheel 30 is aligned generally with the strap support surface 22 and is located adjacent the trailing end portion 26 of the strap support surface 22 opposite the leading end portion 25 thereof, whereby strap tensioned by the feed wheel 30 is drawn over the strap support surface 22 and is maintained in alignment therewith by the strap guide, as discussed more fully below.

In FIGS. 1,2, 4*a* and 4*b*, the strap guide includes a wall portion 40 disposed at least partially along the inner portion 27 of the strap support surface 22 and extending thereabove to guide strap supported on the strap support surface 22 during tensioning. The wall portion 40 may be part of the tool housing as in the exemplary embodiment, or alternatively may be a guide rail or some other structure disposed at least partially along the inner portion 27 of the strap support surface 22 and extending above a portion thereof to guide strap along the inner portion 27 of the strap support surface 22.

In FIGS. 1 and 2, the strap guide also includes a strap guiding member 50 pivotally coupled to the tool 10 and disposed at least partially along the outer portion 28 of the strap support surface 22, generally opposite the wall portion 40, although not necessarily directly thereacross. The strap guiding member 50 includes a pivot end portion 52 pivotally coupled to the base plate 20, for example by a pivot member 51. The strap guiding member 50 also includes a guide end portion 54 extending above the strap support surface 22. The pivot end portion 52 of the strap guiding member 50 is preferably pivotally coupled to the base plate 20 toward the leading end portion 25 of the strap support surface 22, as illustrated in FIG. 1. The strap guiding member 50 is coupled to the base plate 20 so that the guide end portion 54 extends upwardly therefrom, alongside and above at least a portion of the strap support surface 22 to ensure that the overlapping strap portions 2 and 3 remain confined or retained and guided by the strap guide until tensioning is complete.

According to the invention generally, strap supported on and drawn over the strap support surface 22 by the feed wheel is guided by the wall portion 40 on one side of the strap and by a wall portion 57 of the guide end portion 54 on the another opposing side of the strap, whereby strap supported on the strap support surface 22 is retained and guided between the wall portion 40 and the guide end portion 54 of the strap guiding member 50 until tensioning is complete.

Figure 3A:
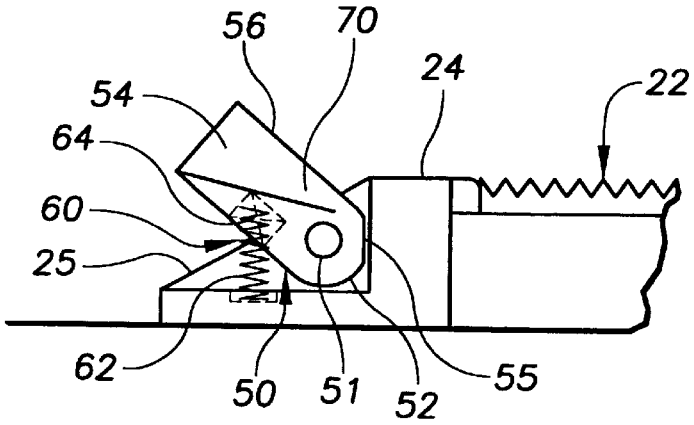
FIG. 3*a* is a partial detailed view of a strap guiding member in a first strap guiding position.

A biasing member is generally coupled to the strap guiding member 50 to pivotally bias the guide end portion 54 thereof above at least a portion of the strap support surface 22 and along side the outer portion 28 thereof, as illustrated best in FIGS. 1 and 2. In FIG. 3*a*, the strap guiding member 50 includes a flattened abutment portion 55 engageable with a portion of the base plate 20 or some other structure to limit the upward travel of the strap guiding member 50 caused by the biasing member.

Figure 5:
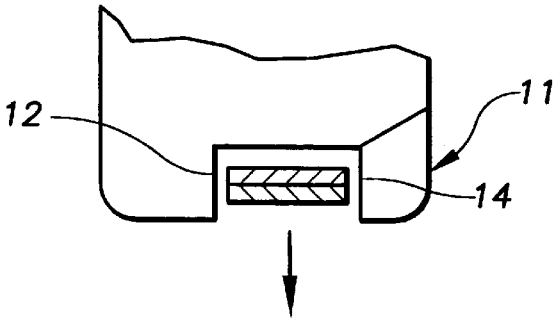
FIG. 5 PRIOR ART
FIG. 5 is a partial end view of a prior art strap guide.
Figure 6:
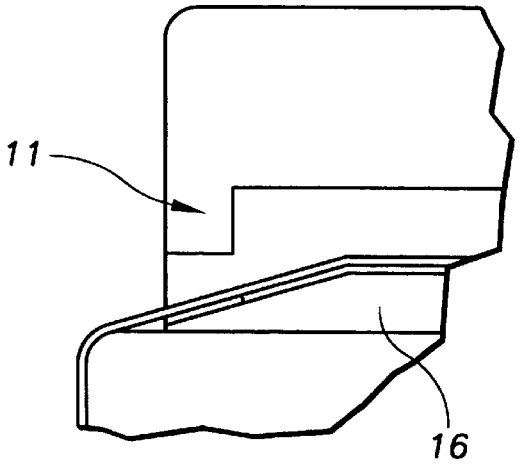
FIG. 6 PRIOR ART
FIG. 6 is a partial side view of a prior art strap guide.

In FIG. 2, the overlapping strap portions 2 and 3 disposed on the strap support surface 22 are confined and guided between the wall portion 40 and the wall portion 57 of the upwardly biased guide end portion 54 of the strap guiding member 50 during strap tensioning. In the present invention, as strap tension increases, the overlapping strap portions 2 and 3 remain confined by the wall portion 40 and the upwardly biased strap guiding member 50. Thus the strap portions 2 and 3 in the present invention are not withdrawn from the strap guide during tensioning as in prior strap guides that extend downwardly from above the support surface as discussed above and illustrated in prior art FIGS. 5 and 6.

Figure 3B:
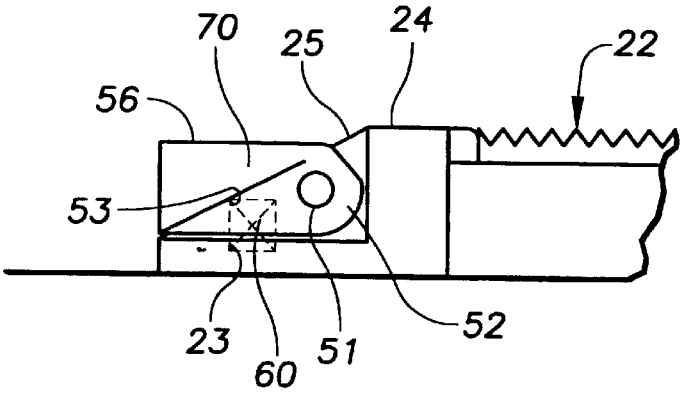
FIG. 3*b* is a partial detailed view of a strap guiding member in a second position to permit release of the strap.

In FIG. 3*a*, the biasing member is preferably a compression spring 60 disposed between the base plate 20 and the strap guiding member 50. A first end portion 62 of the compression spring 60 acts against the base plate, and a second end portion 64 of the compression spring 60 acts against the strap guiding member 50. Generally at least one, and possibly both of the end portions of the compression spring 60 are disposed in corresponding recesses on either or both the base plate 20 or the strap guiding member 50 to retain the spring 60. In FIG. 3*b*, the base plate 20 has a recess 23 and the strap guiding member 50 has a recess 53 for accommodating corresponding end portions of the compression spring 60.

In other alternative embodiments, a torsional spring, not shown, may be employed to bias the guide end portion 54 of the strap guiding member 50 above the strap support surface 22 along side the outer portion thereof. The torsional spring, for example, may be disposed about the pivot shaft 51 so that a first arm portion of the torsional spring engages the base plate and a second arm portion thereof engages the strap guiding member 50 to bias the guide end portion 54 thereof upwardly.

In FIGS. 2, 3*a* and 3*b*, the biasing member pivotally biases the strap guiding member 50 so that the guide end portion 54 thereof extends above the intermediate portion 24 of the strap support surface 22. The pivotal movement of the strap guiding member 50 is limited by the abutment portion 55 thereof engaging the base plate 20, as discussed above. In FIG. 3*b*, the strap guiding member 50 is pivotal downwardly against the bias of the biasing member so that an upper portion 56 thereof does not extend above the intermediate portion 24 of the strap support surface 22, thereby permitting removal or withdrawal of the base plate 20 from between the load and strap tensioned thereabout without interference by the strap guiding member 50, as discussed more fully below.

In FIGS. 2, 3*a* and 3*b*, the strap guiding member 50 includes preferably a beveled portion 70 on the upper and outer portions thereof. The beveled portion 70 is engageable by a strap portion to downwardly pivot the strap supporting member 50 and more particularly the guide end portion 54 thereof against the bias of the biasing member to facilitate insertion of the strap into the strap guide and onto the strap support surface 22 of the base plate 20. The strap guiding member 50 however is pivotal downwardly in the absence of the beveled portion 70, and in some embodiments the bevelled portion 70 is not included.

In FIGS. 1 and 3*a*, the strap guiding member 50 is pivotally coupled to the base plate 20 so that the guide end portion 54 of the strap guiding member extends away from the feed wheel 30. The upper portion 56 of the strap guiding member 50 is disposed at an angle relative to the strap support surface 22 of the base plate 20 when the strap engagement portion is biased to extend above the strap support surface. In the exemplary embodiment, the upper portion 56 of the strap guiding member 50 is at an angle relative to the intermediate portion 24 of the support surface 22. The upper portion 56 of the strap guiding member 50 is engageable by the overlapping tensioned strap portions to downwardly pivot the strap guiding member 50 as the tool and more particularly the foot 20 is removed from between the load and strap tensioned thereabout, as discussed more fully below.

Figure 4A:
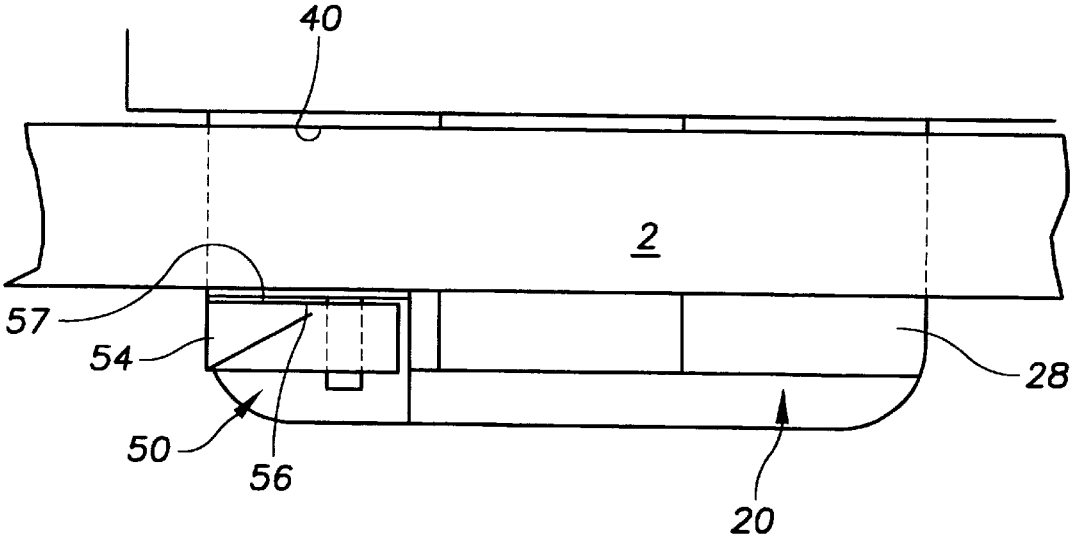
FIG. 4*a* is a partial top view of strap retained by a strap guide.

In FIG. 4*a*, the strap 2 is disposed between and guided by the wall portion 40 and the guide end portion 54 of the strap guiding member 50 during tensioning. Upon completion of tensioning, the base plate 20 of the tool is withdrawn from between the tensioned strap and the load by a pivoting action of the tool, as is common practice for separating tensioning tools from tensioned strap.

Figure 4B:
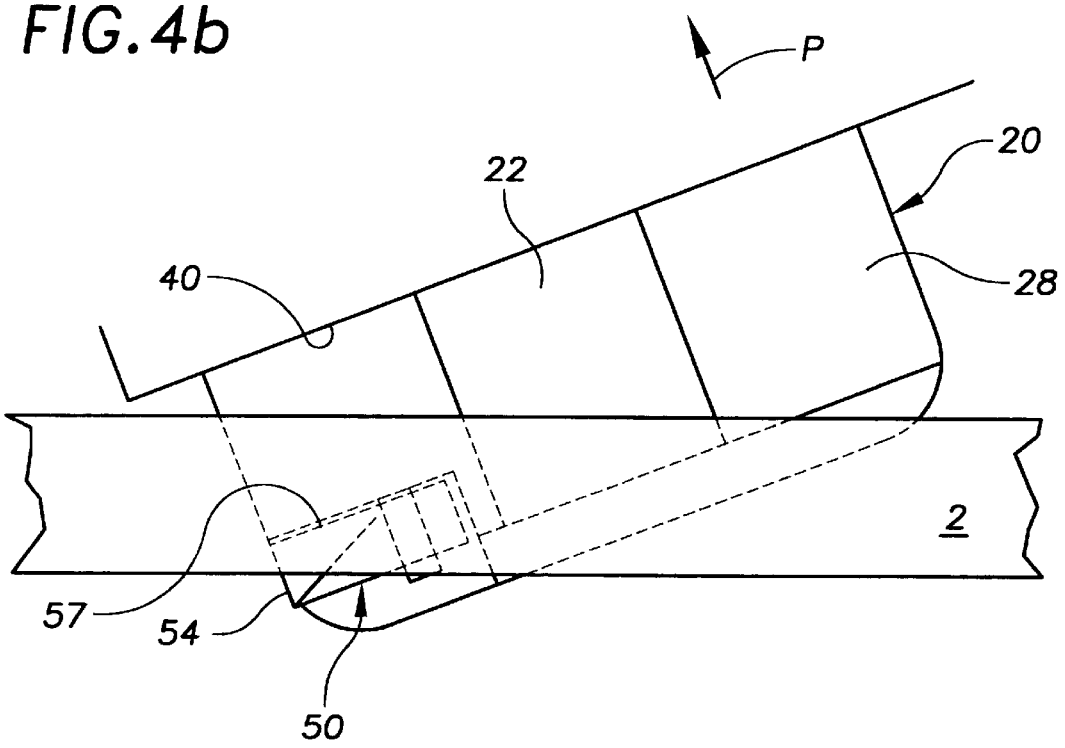
FIG. 4*b* is a partial top view of strap being released from a strap guide.

In FIG. 4*b*, the trailing end portion 28 of the base plate 20 is first withdrawn from between the tensioned overlapping strap and the load upon pivoting the tool in the direction of arrow P. As the tool and base plate 20 are pivoted relative to the tensioned strap, the strap engages the upper portion 56 of the strap guiding member 50, which is oriented at an angle relative to the strap support surface 22 and directed generally away from the feed wheel, as discussed above. The tensioned strap thus pivots the strap guiding member 50 downwardly against the bias of the biasing member, as illustrated in FIG. 3*b*, whereupon the base plate 20 and more particularly leading end portion 27 of the strap support surface 22 thereof may be withdrawn completely from between the load and the tensioned strap.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A strap tensioning tool comprising:

a base plate having a strap support surface, the strap support surface having an inner portion, an outer portion and a leading end portion;

a wall portion extending above the strap support surface and disposed at least partially along the inner portion thereof;

a strap guiding member having a pivot end portion and a guide end portion, the pivot end portion pivotally coupled to the tool along the outer portion of the strap support surface generally opposite the wall portion;

a biasing member coupled to the strap guiding member to pivotally bias the guide end portion of the strap guiding member above at least a portion of the strap support surface, whereby strap disposed on the strap support surface of the base plate is guided between the wall portion and the strap guiding member during tensioning.

2. The tool of claim 1, strap support surface of the base plate having an intermediate portion, the biasing member pivotally biases the strap guiding member so that the guide end portion thereof extends above the intermediate portion of the strap support surface.

3. The tool of claim 2, the strap guiding member has an upper portion, the strap guiding member is pivotal downwardly against the bias of the biasing member so that the upper portion of the strap guiding member does not extend above the intermediate portion of the strap support surface.

4. The tool of claim 2, the leading end portion of the strap support surface slopes downwardly away from the intermediate portion thereof.

5. The tool of claim 1 further comprising a feed wheel aligned with the strap support surface of the base plate, the strap guiding member is pivotally coupled to the base plate so that the guide end portion of the strap guiding member extends away from the feed wheel.

6. The tool of claim 5, the strap guiding member having a bevelled portion on upper and outer portions thereof.

7. The tool of claim 5, the pivot end portion of the strap guiding member is pivotally coupled to the base plate toward the leading end portion of the strap support surface.

8. The tool of claim 5, an upper portion of the strap guiding member is at an angle relative to the strap support surface of the base plate when the guide end portion of the strap guiding member is biased to extend above at least a portion of the strap support surface.

9. The tool of claim 1, an upper portion of the strap guiding member is at an angle relative to the strap support surface of the base plate when the guide end portion of the strap guiding member is biased to extend above at least a portion of the strap support surface.

10. The tool of claim 1 further comprising a feed wheel aligned with the strap support surface of the base plate, the feed wheel located generally opposite the leading end portion of the strap support surface, whereby strap tensioned by the feed wheel is drawn over the strap support surface between the wall portion and the strap guiding member.

11. The tool of claim 1, the biasing member is a compression spring disposed between the base plate and the strap guiding member.

12. A method for guiding strap in a tensioning tool, comprising:

drawing tensioned strap with a feed wheel over a strap support surface of a base plate;

guiding strap drawn over the strap support surface on one side of the strap with a wall portion extending above the strap support surface and disposed at least partially along an inner portion of the strap support surface;

biasing a strap guiding member pivotally coupled to the base plate so that a guide end portion of the strap guiding member extends above at least a portion of the strap support surface along an outer portion of the strap support surface generally opposite the wall portion, guiding strap drawn over the strap support surface on another side of the strap with the guide end portion of the strap guiding member when the guide end portion is biased to extend above at least a portion of the strap support surface, whereby strap is retained between the wall portion and the strap guiding member until tensioning is complete.

13. The method of claim 12 further comprising biasing the guide end portion of the strap guiding member so that the guide end portion of the strap guiding member extends away from the feed wheel.

14. The method of claim 13 further comprising biasing the guide end portion of the strap guiding member so that an upper portion of the strap guiding member is at an angle relative to the strap support surface of the base plate when the guide end portion of the strap guiding member is biased to extend above at least a portion of the strap support surface.

15. The method of claim 12 further comprising pivoting the strap guiding member downwardly against the bias of a biasing member so that an upper portion of the strap guiding member does not extend above an intermediate portion of the strap support surface.

16. The method of claim 12 further comprising biasing the guide end portion of the pivotal strap guiding member so that an upper portion of the strap guiding member is at an angle relative to the strap support surface of the base plate when the guide end portion of the strap guiding member is biased to extend above at least a portion of the strap support surface.

17. The method of claim 16 further comprising pivoting the strap guiding member downwardly against the bias of a biasing member by engaging the upper portion of the strap guiding member with strap disposed between the wall portion and the guide end portion of the strap guiding member by pivoting the tool.

18. The method of claim 12 further comprising pivoting the strap guiding member downwardly against the bias of a biasing member by engaging a bevelled portion on upper and outer portions of the strap guiding member.

19. The method of claim 12 further comprising biasing the guide end portion of the pivotal strap guiding member to extend above at least a portion of the strap support surface with a compression spring member disposed between the strap guiding member and the base plate.

* * * * *